United States Patent [19]

Pitts

[11] Patent Number: 4,979,626

[45] Date of Patent: Dec. 25, 1990

[54] CONVERTIBLE HANGING FILE FOLDER (1)

[75] Inventor: Warren R. Pitts, Needham, Mass.

[73] Assignee: Dennison Manufacturing Company, Framingham, Mass.

[21] Appl. No.: 905,804

[22] Filed: Sep. 10, 1986

[51] Int. Cl.[5] ..... A47F 7/00

[52] U.S. Cl. ..... 211/45; 312/184

[58] Field of Search ..... 211/10, 11, 45, 46; 312/184; 402/4

[56] References Cited

U.S. PATENT DOCUMENTS

| | | | |
|---|---|---|---|
| 3,826,582 | 7/1974 | Podosek | 312/184 X |
| 3,865,445 | 2/1975 | Dean et al. | 312/184 |
| 3,936,201 | 2/1976 | Kenney et al. | 312/184 X |
| 4,114,963 | 9/1978 | Menahem | 312/184 |
| 4,400,103 | 8/1983 | Pitts | 312/184 X |
| 4,576,328 | 3/1986 | Snider et al. | 312/184 X |

FOREIGN PATENT DOCUMENTS

| | | | |
|---|---|---|---|
| 237284 | 7/1986 | U.S.S.R. | 312/184 |

*Primary Examiner*—Sarah A. Lechok

*Attorney, Agent, or Firm*—George E. Kersey

[57] ABSTRACT

A file folder capable of being suspended from a hanging storage rack, having first and second straight shank ordinary fasteners for mounting first and second hanger members upon the file folder and whereby terminal portions of the hanger members are selectively positioned inside of the file folder or outside of the folder to enable the folder to be hung within an ordinary hanging storage rack. The fasteners also bind papers to the folder at the same time.

9 Claims, 2 Drawing Sheets

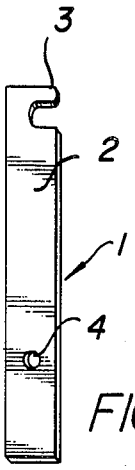
FIG. 1
FIG. 2
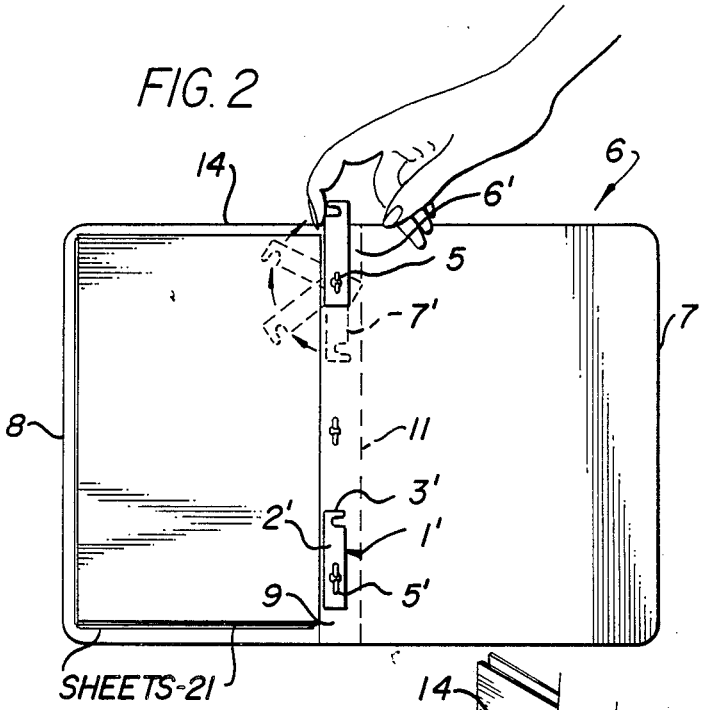
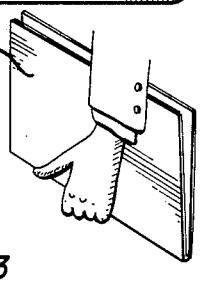
FIG. 2A
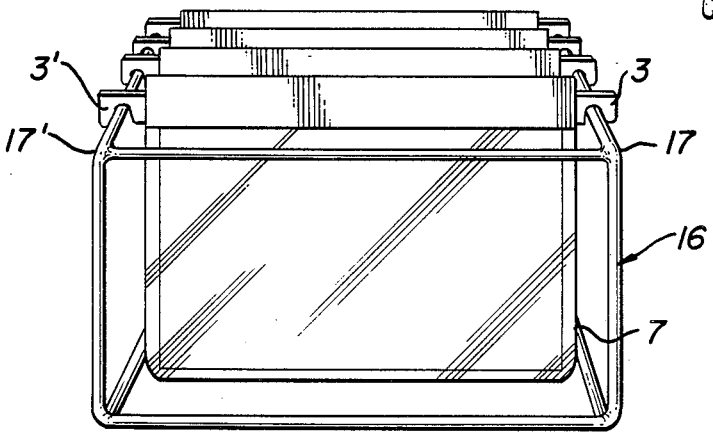
FIG. 3

CONVERTIBLE HANGING FILE FOLDER (1)

BACKGROUND OF THE INVENTION

The present invention relates to hanging file folders utilized to store documents within hanging file storage racks.

The use of hanging file folders is commonplace, wherein the folders are suspended from a pair of support arms within a hanging storage rack, and typically, a file folder having bound sheets therein is positioned within each hanging file folder and usually has an identification tab extending from the upper surface thereof, so that the user may readily identify the files which are often tightly packed within the hanging folder rack.

It is an object of this invention to eliminate the separate use of the hanging file folders for containing associated files therein and thus reducing costs to the consumer.

It is an additional object of this invention to provide a file folder for containing documents, which may be readily converted by the user into a folder which may be hung within the hanging rack without the need for the separate hanging file folder.

SUMMARY OF PREFERRED EMBODIMENTS OF THE INVENTION

A pair of ordinary pointed shank paper fasteners are passed through a pair of punched holes in a stack of paper making up the file and are passed through holes formed within a pair of thin flexible hanger members having hook portions at terminal ends thereof. The shanks are thereafter bent back and pressed against the hanger members, and as a result, the papers making up the file are bound within in the file. The hanger members are configures so that in a first position they may be pivoted about the fastener shanks causing each hanger member to be positioned totally within the file whereas they may be rotated 180° to a second position, to cause the hook portions to extend beyond the edges of the file. In the latter case the file may be readily hung within an ordinary hanging rack. When it is desired to remove the file and transport it to another location, the thin flat hanging members are rotated so that they are tucked within the file folder.

In accordance with another embodiment of the invention, an elongated slot is formed within each hanger member, to enable the members to be translated between the aforesaid positions rather than being rotated between positions. As a result, the aforesaid separate hanging file folder has been eliminated since the folder of the invention has the dual function described above. Another beneficial result of eliminating the conventional file folder is that space is saved to permit more files to be stored within a given file drawer. In accordance with a subsidiary feature of the invention, the usual practise of typing and mounting ID tabs upon each hanging file is no longer needed since the report title on the paper cover sheet adjacent the transparent plastic sheet may be viewed.

BRIEF DESCRIPTION OF THE DRAWINGS

Other objects, features, and advantages of the invention will become apparent upon study of the following description taken in conjunction with the drawings in which:

FIG. 1 illustrates one of two hanger members;

FIG. 2 illustrates the dual positioning of two hanger members mounted upon the file folder;

FIG. 2*a* illustrates the file folder being carried whereby the terminal portions of the hanger members are positioned inside of the folder;

FIG. 3 illustrates a hanging rack for storing the file folders;

DESCRIPTION

Figure 4:
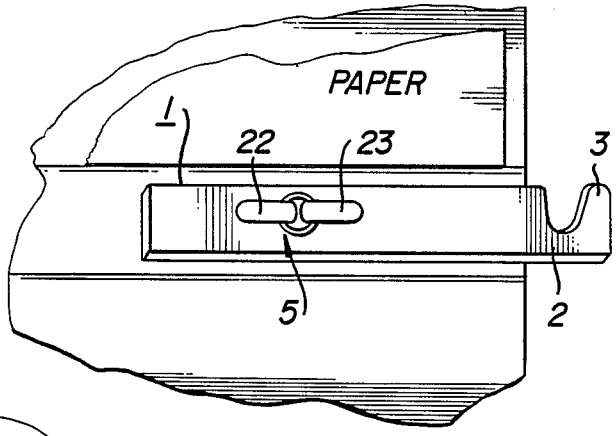
FIG. 4 illustrates in greater detail the fastening of the hanger to the file folder.

In FIG. 1, hanger member 1 comprising an elongated strip of metal or plastic has a terminal portion 2 with a hook 3 positioned therein. Hole 4 is formed within the hanger member and is utilized to mount the member upon the file folder as illustated in FIG. 2. An ordinary pointed shank paper fastener is passed through a hole formed within folder 6, through punched holes in sheets 21, and through hole 4 within hanger member 1, and the shanks are then folded back as shown in FIG. 2 to rotatably couple hanger member 1, and sheets 21, to a centralized portion of file folder 6 as illustrated. Folder 6 consists of a first outer sheet 7 and a second outer sheet 8 joined by at least one fold 9 and optionally by a second fold shown as a dotted line at 11. In like manner, a second hanger member 1' is mounted upon the folder by means of shank fastener 5'. Hanger member 1' is illustrated in FIG. 2 in a first position whereby the member is totally within the file folder. At the upper portion of the figure, hanger member 1 has been rotated from the first position shown in dotted lines, 180° to a second position, whereby the terminal portion 2 of the hanger member extends outwardly with respect to the upper edge 14 of the file folder. When it is desired to suspend folder 6 within the hanging rack 16 illustrated in FIG. 3, both hanging members will have their terminal portions 2 and 2' including hook members 3 and 3' extending from the edges of the file folder to enable the hooks to bear against portions 17 and 17' of rack 16 to support the folder. Sheet 7 of folder 6 may be transparent, so that the cover sheet of the papers mounted within the folder may be visible to a user flipping through the suspended files of FIG. 3. This approach eliminates the usual practise of typing and mounting I.D. tabs upon each hanging file, since the report title on the paper cover sheet adjacent plastic sheet 7 may be readily viewed.

Figure 5:
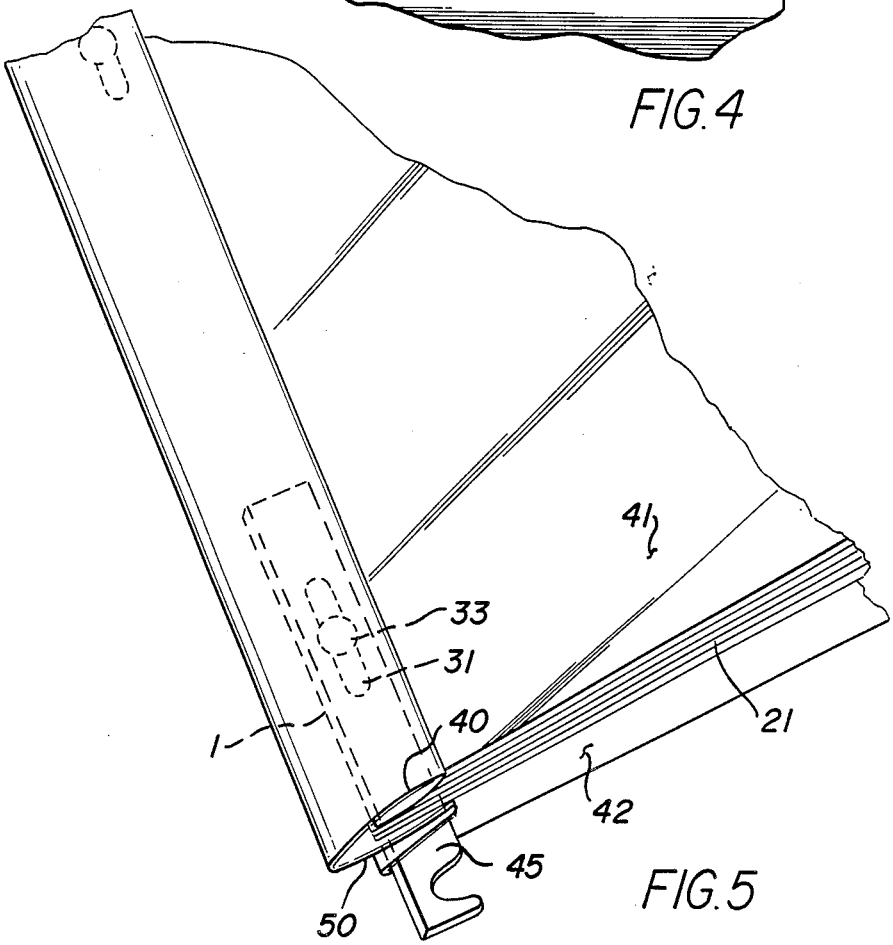
FIG. 5 illustrates another type of hanger member fastening device.

Now let it be assumed that the user wishes to remove a hanging file folder and carry it to another destination. Hanging members 1 and 1' are again rotated 180° so that each assumes the position of member 1' illustrated at the lower portion of FIG. 2 whereby terminal portions 2 and 2', including hooks 3 and 3', no longer extend from the edges of folder 6. Punched hole paper sheets 21 illustrated in FIGS. 2 and 5 are positioned between hanger member 1 and the file folder itself; the elongated shank paper fastener is first passed through a hole in the file then passed through holes in the paper sheets making up the file, and lastly passed through a hole in the hanger member, and shanks 22 and 23 of the pointed shank fastner are bent back flat against the surface of hanger member 1 as shown in FIG. 4. The fastener and hanger member, which is typically a piece of thin plastic or metal, is thus utilized to easily assemble the convertible file folder.

In FIG. 5, a plurality of paper sheets 21 are shown each of which has a punched hole for receiving the shanks of the paper fastener. However, hanger member 1 has an elongated slot 31 therein, enabling the hanger member to be shifted or translated between the aforesaid first and second positions without being rotated. The head of the metal fastener 33 is also illustrated and has a diameter greater than the width of slot 31.

A bound report is illustrated having transparent front and back covers 41 and 42 which are double-folded as illustrated to accommodate the non-pivoting fastening arrangement described above. In this arrangement, the head of the fastener 33 is positioned above elongated slot 31 formed within hanger member 1. The shanks are first passed through a hole in fold 40, then through slot 33, the holes in paper sheets 21 and are thereafter folded back as illustrated in FIG. 4 to join the hanger member, papers 21, and fold 40 together.

If desired the shanks could also be passed through holes in zig-zaged number folds 45 and 50 for a better bond to the file folder.

The description presented is merely exemplary, and numerous variations may be made in practising the invention and thus the scope of the invention is to be limited only by the terms of the claims and equivalents thereof.

What is claimed is:

1. A file folder capable of being suspended from a hanging storage rack, having first and second cover sheets joined together along at least one centralized fold;

first fastener means for mounting a first hanger member upon a first inside portion of said file folder adjacent said fold;

second fastener means for mounting a second hanger member upon a second inside portion of said file folder widely separated from said first portion and adjacent said fold; position altering means for enabling said first and second hanging members to assume first positions whereby terminal portions of said hanger members are positioned inside of said file folder and to assume second positions whereby terminal portions of said hanger members are positioned outside of said file folder to enable said file folder to be hung within said hanging storage rack wherein said first and second fastener means are pivotably coupled to said first and second hanger members for enabling said hanger members to be rotated 180° to cause said hanger members to selectively assume said first or second positions.

2. The file folder of claim 1 wherein said hanger members include hook means positioned at terminal portions thereof.

3. The file folder of claim 1 wherein said fastening means comprise pointed shank paper fasteners.

4. The file folder of claim 2 wherein said fastening means comprise pointed shank paper fasteners.

5. The file folder of claim 3 wherein said position altering means include holes formed within said file folders and said hanger members for accommodating the shanks of said paper fasteners.

6. The file folder of claim 4 wherein said position altering means include holes formed within said file folders and said hanger members for accommodating the shanks of said paper fasteners.

7. The file folder of claim 1 wherein at least one of said cover sheets is transparent, thereby to eliminate the need for an identification tab for identifying said folder.

8. The file folder of claim 3 wherein at least one of said cover sheets is transparent, thereby to eliminate the need for an identification tab for identifying said folder.

9. The file folder of claim 5 wherein at least one of said cover sheets is transparent, thereby to eliminate the need for an identification tab for identifying said folder.

* * * * *